United States Patent [19]

Temburg

[11] Patent Number: 4,756,059

[45] Date of Patent: Jul. 12, 1988

[54] FIBER BALE OPENER

[75] Inventor: Josef Temburg, Jüchen, Fed. Rep. of Germany

[73] Assignee: Trützschler GmbH & Co. KG, Monchen-gladbach, Fed. Rep. of Germany

[21] Appl. No.: 9,521

[22] Filed: Feb. 2, 1987

[30] Foreign Application Priority Data

Jan. 31, 1986 [DE] Fed. Rep. of Germany ..... 3602897
Nov. 3, 1986 [DE] Fed. Rep. of Germany ..... 3637351

[51] Int. Cl.[4] ..... D01G 7/10; D01G 7/04
[52] U.S. Cl. ..... 19/80 R; 19/81
[58] Field of Search ..... 19/80 R, 81

[56] References Cited

U.S. PATENT DOCUMENTS 3,736,624 6/1973 Alt et al. ..... 19/80 R
4,297,767 11/1981 Leifeld ..... 19/80 R
4,510,646 4/1985 Locatelli ..... 19/80 R
4,513,479 4/1985 Binder et al. ..... 19/80 R
4,554,708 11/1985 Leifeld et al. ..... 19/80 R

*Primary Examiner*—Louis K. Rimrodt
*Attorney, Agent, or Firm*—Spencer & Frank

[57] ABSTRACT

A fiber bale opener includes a downwardly open housing adapted to be supported above fiber bales to be opened and accommodating an opening device having a width dimension. The opening device includes an opening roller oriented parallel to the width dimension and arranged for removing fiber tufts from upper bale surfaces and a suction duct through which fiber tufts detached from the bales by the opening roller are adapted to be removed by a suction air stream flowing therethrough. The suction duct has two transverse walls facing one another and being spaced from one another in a direction perpendicular to the width dimension. The transverse walls extend substantially over the entire width dimension and each has a lower terminus defining a zone with an upper bale face situated underneath the opening device during operation thereof. The zone is sealed for substantially preventing air from passing therethrough along the width dimension of the opening device.

14 Claims, 3 Drawing Sheets

FIBER BALE OPENER

BACKGROUND OF THE INVENTION

This invention relates to a travelling fiber bale opener for detaching fiber tufts from fiber bales such as cotton fiber bales, synthetic fiber bales or the like. The bale opener has an opening device which has at least one opening roller (detacher) mounted in a housing and the fiber tufts torn from the fiber bale are removed from the zone of the opening roller by means of a suction duct which has two transverse walls oriented transversely to the travelling direction of the bale opener and extending over the entire width of the opening device, generally parallel to the axis of the opening roller. A tuft-conveying suction air stream is passed through the suction duct.

In a known apparatus, within the housing there are arranged an opening roller and a generally tubular suction duct. Fresh air is drawn in from the zones where the opening roller and the suction duct project bilaterally and horizontally beyond the fiber bales. The transverse walls of the suction duct terminate at a distance above the bale surface. In this manner, between the lower edge of the transverse walls and the upper surface of the bale a vertical gap is present through which additional fresh air is drawn in.

It is a disadvantage of the above-outlined prior art constructions that by virtue of the additional air intake, the entire air velocity drops within the suction duct, resulting in a reduction of the removal efficiency.

SUMMARY OF THE INVENTION

It is an object of the invention to provide an improved apparatus of the above-outlined type from which the discussed disadvantages are eliminated and which, in particular, ensures an increased air speed within the suction duct and thus makes possible an amelioration of the suction output.

This object and others to become apparent as the specification progresses, are accomplished by the invention, according to which, briefly stated, the zone between the lower end of the transverse walls of the suction device and the upper face of the fiber bales is closed off by a sealing device.

By virtue of the fact that at least on one side of the opening roller the zone between the lower edge of a transverse wall of the suction duct and the upper face of the fiber bale is sealed, an intake of an additional partial stream into the suction duct from the outside is prevented. In this manner the velocity of the intake air which is drawn from the lateral zone is increased resulting in an improvement of the suction output.

According to an advantageous feature of the invention, the sealing is effected by a sealing element which expediently is elastically flexible. In order to be able to regulate the degree of fresh air intake, the sealing element is pivotally mounted to be swingable about an edge thereof. Such an arrangement is of particular advantage in case the vacuum in the suction duct increases excessively.

According to a preferred embodiment of the invention in which parallel to the opening rollers an upstream and a downstream bale pressing roller is arranged, the sealing element is provided between the lower end of at least one of the transverse walls of the suction duct and the adjacent pressing roller. In case the pressing roller is of the type which has axially spaced toothed discs, the sealing element has spaced cutouts for permitting passage of the respective toothed discs.

DESCRIPTION OF THE PREFERRED EMBODIMENTS

Figure 1:
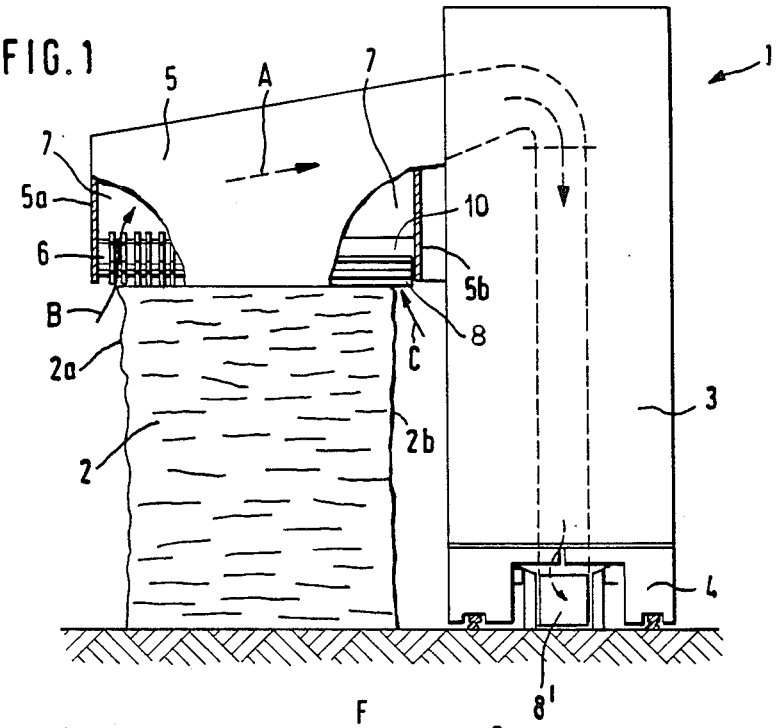
FIG. 1 is a schematic, partially sectional front elevational view of a bale opener incorporating a preferred embodiment of the invention.
Figure 2:
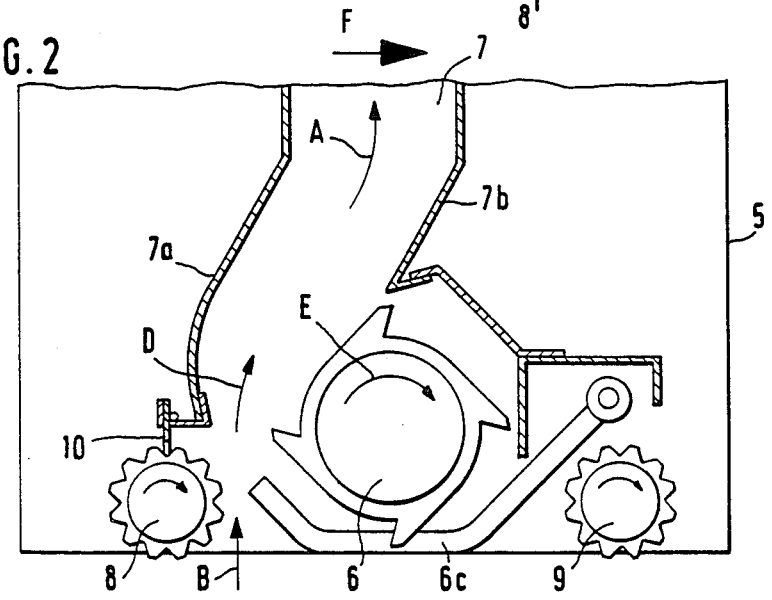
FIG. 2 is a schematic sectional side elevational view, on an enlarged scale, of a part of the structure shown in FIG. 1.

Turning to FIGS. 1 and 2, a travelling bale opener generally designated at 1 which may be a "BLENDOMAT" model manufactured by Trützschler GmbH & Co. KG, Mönchengladbach, Federal Republic of Germany, has, for removing fiber tufts from the upper face of a series of fiber bales 2 supported on the ground, a tower 3 mounted on a wheeled carriage 4 for travelling on rails laid on the floor. The tower 3 may rotate about a vertical axis relative to the carriage 4. The tower 3 has a laterally projecting, downwardly open cantilevered housing 5 which may be raised or lowered relative to the tower 3. In the housing 5 there is accommodated an opening (detaching) device such as an opening roller 6 as well as a suction duct 7 through which fiber tufts detached by the opening roller 6 are removed by a suction air stream generated, for example, by a blower, not shown. Underneath the tower 3 between the rails there is provided a channel 8' for receiving the fiber tufts conveyed by the air stream downwardly through the tower 3. The fiber tufts are subsequently removed by a conveying air stream from the channel 8'. During operation, the carriage 4 travels alongside the fiber bales 2 and the opening device 6 is moved along the upper face of the fiber bales.

The opening device further has a grate **6*c* which presses down on the fiber bale. The teeth of the opening roller 6 project through the grate bars and penetrate into the fiber bale surface. The fiber tufts detached from the fiber bale by the opening roller 6 are removed from the zone adjacent the opening roller 6 by means of an air stream A guided in the suction duct 7. The latter has two opposite transverse walls *7a, 7b* oriented transversely to the travelling direction F of the bale opener and extending over the entire width of the opening device. The transverse walls *7a, 7b*** are spaced from one another in a direction parallel to the travelling direction F.

Axially parallel to the opening roller 6 there are mounted two pressing rollers 8 and 9 which sealingly press down on the upper face of the fiber bales 2. Between the pressing roller 8 and the lower edge of the transverse wall *7a* of the suction duct 7 a sealing element 10 is provided which, at the discharge side of the opening roller 6, prevents outside air from entering into the region between the pressing roller 8 and the opening roller 6 along the entire length thereof. As shown in FIG. 1, the air stream parts B and C enter from the outside into the suction duct 7 only at the two lateral zones 2*a* and 2*b* of the fiber bales 2. Thus, between the side walls 5*a* and 5*b* of the housing 5 and the corresponding lateral surfaces 2*a* and 2*b* the air streams B and C may enter the suction duct 7 essentially from below. The air stream designated at D (FIG. 2) receives the fiber tufts detached by the opening roller 6 and thrown thereby outwardly. The pressing roller 8 is of fluted construction and the resilient sealing element 10 is arranged to project into the top axial groove of the pressing roller 8 and is deflected by the crest parts thereof during its rotation.

Figure 3:
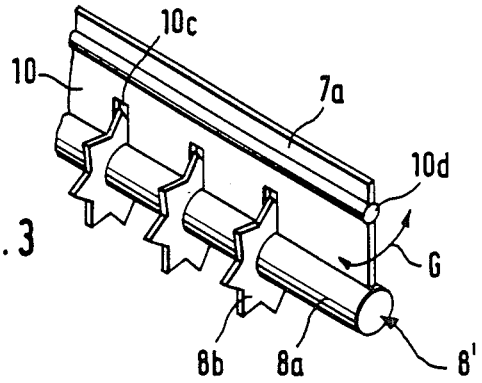
FIG. 3 is a perspective view of another preferred embodiment of the invention.

Turning now to FIG. 3, the pressing roller 8′ shown therein is of the type which has a shaft 8*a* carrying axially spaced toothed discs 8*b*. According to the invention, a sealing element 10′ is situated between the lower end of the transverse wall 7*a* of the suction duct 7 on the one hand and the shaft 8*a* and the toothed discs 8*b* of the pressing roller 8′. The sealing element 10′ has spaced, slot-like cutouts 10*c* into which project the respective toothed discs 8*b*. The sealing element 10′ is, along its upper edge, pivotally attached at 10*d* to the wall 7*a*, whereby it may be swung away from its vertical position as indicated by the double-headed arrow G.

Figure 4:
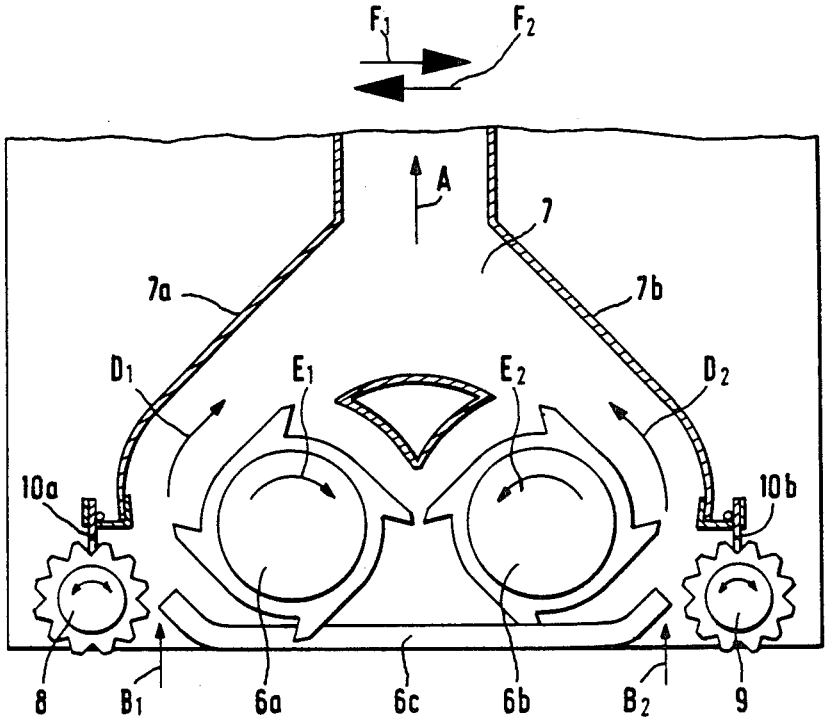
FIG. 4 is a schematic sectional side elevational view, similar to FIG. 2, of another preferred embodiment of the invention.

Turning now to FIG. 4, the embodiment illustrated therein has two opening rollers 6*a* and 6*b*. The air streams B1, B2, the corresponding non-illustrated streams on the other side of the device as well as the air streams $D_1$, $D_2$ are combined into the air stream A. The pressing rollers 8 and 9 extend along the entire length of the opening rollers 6*a*, 6*b* and are of fluted construction. The sealing elements 10*a* and 10*b* are elastic and extend into the top groove of the pressing rollers. This arrangement prevents air from entering into the suction duct 7 above the fiber bales between the pressure rollers 8 and 9 on the one hand and the transverse walls 7*a*, 7*b* of the suction duct 7 on the other hand. The bale opener depicted in FIG. 4 has two travelling directions $F_1$ and $F_2$; the direction of rotation of the opening rollers 6*a* and 6*b* is designated at $E_1$ and $E_2$, respectively.

Figure 5:
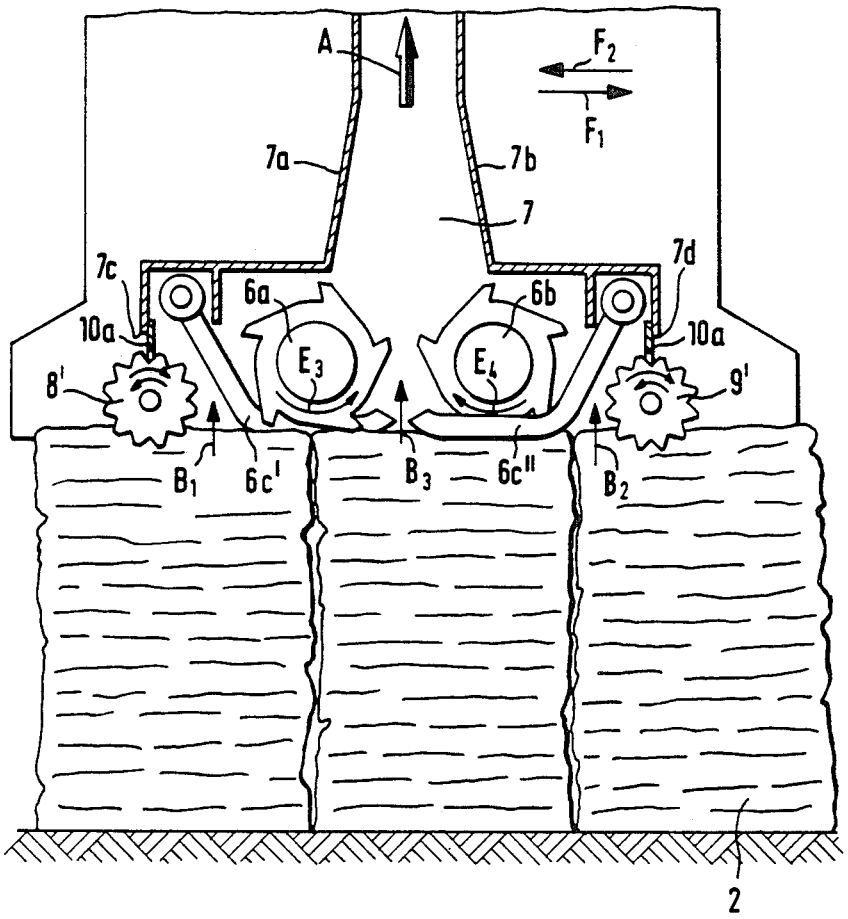
FIG. 5 is a schematic sectional side elevational view, similar to FIG. 4, of still another preferred embodiment of the invention.

Turning now to FIG. 5, there is illustrated an embodiment which has two opening rollers 6*a* and 6*b* whose direction of rotation, designated at $E_3$ and $E_4$, is such that the opening rollers 6*a* and 6*b* rotate in their lower zone towards one another (that is, inwardly) and the fiber tufts detached by the opening rollers 6*a* and 6*b* are thrown between the opening rollers 6*a* and 6*b* upwardly and are drawn into the suction duct 7 by the air stream A. The pressing rollers 8′ and 9′ have toothed discs similar to the embodiment described in connection with FIG. 3. The sealing elements 10*a* and 10*b* are elastic and extend into the spaces defined between the toothed discs as shown in FIG. 3. In this manner, an air intake into the suction duct 7 from the outside above the fiber bales 2 between the pressing rollers 8′ and 9′ and the transverse walls 7*a*, 7*b* is prevented. The zone between the lower terminal edges 7*c*, 7*d* of the transverse walls 7*a*, 7*b* and the zones situated above the fiber bales 2 of the pressing rollers 8′ and 9′ is thus sealed on the respective outer side of the opening rollers 6*a* and 6*b*. The embodiment according to FIG. 5 has the advantage that the suction air stream A is concentrated on the central air stream $B_3$ (entering from the outside) so that the detached fiber tufts are conveyed into the suction duct 7. The sealing elements 10*a*, 10*b* provide that between the lower terminal edges 7*c*, 7*d* of the transverse walls 7*a*, 7*b* and the pressing rollers 8′ and 9′ no undesired air streams are drawn in from the outside which would divide the suction output of the air stream A and thus would thereby weaken its effect. Although, to be sure, between the pressing rollers 8′ and 9′ and the pressing grate bars 6*c*′, 6*c*″ air streams $B_1$ and $B_2$ enter, these air streams, however, are weaker because the air streams generated by the rapidly rotating opening rollers 6*a* and 6*b* oppose the air streams $B_1$, $B_2$. In this manner, undesired lateral errant air streams which do not convey any fiber tufts are avoided and the suction air stream which carries the fiber tufts is concentrated in the middle between the opening rollers 6*a* and 6*b*.

The present disclosure relates to subject matter contained in Federal Republic of Germany Patent Application No. P 36 02 897.5 (filed Jan. 31st, 1986) and Federal Republic of Germany Patent Application No. P 36 37 351.6 (filed Nov. 3rd, 1986) which are incorporated herein by reference.

It will be understood that the above description of the present invention is susceptible to various modifications, changes and adaptations, and the same are intended to be comprehended within the meaning and range of equivalents of the appended claims.

What is claimed is:

1. In a fiber bale opener including a downwardly open housing adapted to be supported above fiber bales to be opened and accommodating an opening device having a width dimension; said opening device including an opening roller oriented parallel to the width dimension and arranged for removing fiber tufts from upper bale surfaces and a suction duct through which fiber tufts detached from the bales by the opening roller are adapted to be removed by a suction air stream flowing therethrough; said suction duct having two transverse walls facing one another and being spaced from one another in a direction perpendicular to the width dimension; said transverse walls extending substantially over the entire width dimension and each having a lower terminus defining a zone with an upper bale face situated underneath the opening device during operation thereof; the improvement comprising means for sealing said zone for substantially preventing air from passing through said zone along said width dimension.

2. A fiber bale opener as defined in claim 1, wherein said zone is situated adjacent that side of the opening roller towards which fiber tufts are thrown by the opening roller during rotation thereof.

3. A fiber bale opener as defined in claim 1, wherein said means for sealing comprises a sealing element supported to project downwardly beyond the lower terminus of one of said transverse walls.

4. A fiber bale opener as defined in claim 3, wherein said sealing element is elastically flexible.

5. A fiber bale opener as defined in claim 3, wherein said sealing element is supported such that it is maintained out of contact with the upper bale faces during operation of the opening device.

6. A fiber bale opener as defined in claim 3, wherein said sealing element is pivotally supported for permitting swinging motion thereof.

7. A fiber bale opener as defined in claim 6, wherein said sealing element has an upper horizontal terminal edge; said sealing element being pivotal about an axis substantially coinciding with said terminal edge of said sealing element and said lower terminus of said transverse wall.

8. A fiber bale opener as defined in claim 3, wherein said opening device further includes a pressing roller situated in said zone and oriented parallel to said opening roller; said pressing roller being arranged for pressing down on said upper bale surfaces during operation of the opening device; said sealing element being situated between said lower terminus of said transverse wall and said pressing roller.

9. A fiber bale opener as defined in claim 8, wherein said pressing roller includes a shaft and a plurality of toothed discs spacedly secured to said shaft; said sealing element projecting to the immediate vicinity of said shaft between adjoining toothed discs; said sealing element further including cutouts each straddling a respective said toothed disc.

10. A fiber bale opener as defined in claim 8, wherein said pressing roller has axially parallel flutes about its circumference, separated by axially parallel ribs; said sealing element projecting into one of said flutes.

11. A fiber bale opener as defined in claim 10, wherein said sealing element is swingable in a direction perpendicular to said width dimension to permit sequential deflection thereof by said ribs.

12. A fiber bale opener as defined in claim 11, wherein said sealing element is elastically flexible.

13. A fiber bale opener as defined in claim 3, wherein said opening roller is a first opening roller and said sealing element is a first sealing element; further comprising a second opening roller supported horizontally adjacent and parallel to said first opening roller; first and second pressing rollers situated below the lower terminus of a respective said transverse wall; said first and second pressing rollers flanking said first and second opening rollers and being oriented parallel thereto; said first and second pressing rollers being arranged for pressing down on the upper bale surfaces during operation of the opening device; said first sealing element being situated between said lower terminus of one of said transverse walls and the first pressing roller situated therebelow; further comprising a second sealing element situated between said lower terminus of the other transverse wall and the second pressing roller situated therebelow.

14. A fiber bale opener as defined in claim 13, wherein said first and second opening rollers have respective tuft-ejection sides oriented towards one another; said first and second sealing elements being situated at respective sides of the first and second opening rollers remote from the respective tuft-ejection sides.

* * * * *